US012336609B2

(12) United States Patent
Fan

(10) Patent No.: US 12,336,609 B2
(45) Date of Patent: Jun. 24, 2025

(54) STRUCTURED BAG WITH STRUCTURED CLOSURE

(71) Applicant: KarSun Enterprises, Inc., New York, NY (US)

(72) Inventor: Annie Kar-Wai Fan, New York, NY (US)

(73) Assignee: KARSUN ENTERPRISES, INC., New York, NY (US)

( * ) Notice: Subject to any disclaimer, the term of this patent is extended or adjusted under 35 U.S.C. 154(b) by 780 days.

(21) Appl. No.: 17/517,318

(22) Filed: Nov. 2, 2021

(65) Prior Publication Data

US 2022/0151350 A1 May 19, 2022

Related U.S. Application Data

(60) Provisional application No. 63/115,403, filed on Nov. 18, 2020.

(51) Int. Cl.
*A45C 3/00* (2006.01)
*A45C 13/02* (2006.01)
(Continued)

(52) U.S. Cl.
CPC ..... *A45C 3/001* (2013.01); *A45C 13/02* (2013.01); *A45C 13/04* (2013.01); *A45C 13/10* (2013.01); *A45C 2200/00* (2013.01); *A45D 29/20* (2013.01)

(58) Field of Classification Search
CPC ..... A45C 5/005; A45C 5/02; A45C 13/34; A45C 13/04; A45C 7/0095; A45C 7/00;
(Continued)

(56) References Cited

U.S. PATENT DOCUMENTS 1,513,909 A * 11/1924 Hunter ..... A45C 7/0063 190/103
2,123,454 A * 7/1938 Doppelt ..... A45C 7/0063 190/114
(Continued)

FOREIGN PATENT DOCUMENTS

WO WO-2021019242 A1 * 2/2021 ..... A45C 3/04

OTHER PUBLICATIONS

Barcos, Chameleon Aries Origami Handbag, retrieved from internet archive wayback machine, Sep. 29, 2021, <<https://barcos.shop/collections/all-products/products/aries-chameleon-origami-handbag>>.
(Continued)

*Primary Examiner* — Jes F Pascua
*Assistant Examiner* — Nina K Attel
(74) *Attorney, Agent, or Firm* — FisherBroyles LLP

(57) ABSTRACT

A bag including a flexible bag body and having a structured closure including rigid ribs. The ribs are arranged in a spatial relationship to selectively stiffen and support the bag body in selected areas to define an overall shape of the bag, and to define at least one unsupported operative region of the flexible material that will be highly flexible due to the lack of overlying strengthening ribs, and act as the structured closure. The ribs may be spaced asymmetrically to define a preferred operative region for folding at an intended location. The bag body may define pockets or other internal organizer structure having an open top and the preferred operative region may be defined in vertical alignment with the open top of the organizer to provide easy access to the open top of the organizer. Bags may have any suitable shape and may include one or more structured closures.

18 Claims, 12 Drawing Sheets

(51) Int. Cl.
*A45C 13/04* (2006.01)
*A45C 13/10* (2006.01)
*A45D 29/20* (2006.01)

(58) Field of Classification Search
CPC ..... A45C 7/0059; A45C 7/0077; A45C 3/00; A45C 3/001; A45D 29/20
USPC ..... 383/2, 4, 105, 119; 190/106, 127
See application file for complete search history.

(56) References Cited

U.S. PATENT DOCUMENTS 2,561,042 A * 7/1951 Arnold ..... A45C 5/005 190/125
4,312,431 A * 1/1982 Corey ..... A45C 7/0072 190/104
6,161,665 A * 12/2000 Hoover ..... A45C 3/00 190/125
2021/0085044 A1* 3/2021 Sylvester ..... A45C 13/103

OTHER PUBLICATIONS

Issey Miyaki Inc, "Lucent Gloss," May 27, 2019, retrieved from <<https://www.isseymiyake.com/en/news/4692>>.
Issey Miyaki Inc, "New Items" Jul. 5, 2017, retrieved from <<https://www.isseymiyake.com/en/news/617>>.
WWD, "Issey Miyake filed a provisional disposition to suspend the sale of bags similar to Baobao" Jun. 14, 2019, translated via google translate <<https://www.wwdjapan.com/articles/878282>>.
TFL, "Issey Miyake Lands Unfair Competition Win in Japan Over Copycat Bao Bao Bags," Jul. 24, 2019, <<https://www.thefashionlaw.com/issey-miyake-lands-unfair-competition-win-in-japan-over-copycat-bao-bao-bags/>>.

* cited by examiner

STRUCTURED BAG WITH STRUCTURED CLOSURE

This application claims the benefit of priority under 35 U.S.C. § 119(e) of U.S. Provisional Patent Application No. 63/115,403, filed Nov. 18, 2020, the entire disclosure of which is hereby incorporated herein by reference.

FIELD OF THE INVENTION

The present invention relates generally to the field bags, such as handbags, totes, fanny packs, backpacks and cosmetic/other organizers, and more particularly to a bag having a structured closure providing for at least two states, one in which the bag is closed and resembles a conventional bag/purse/clutch/backpack/pack having a closed end/top, and another in which the bag closure is open according to structure of the structured closure, and may resemble a conventional organizer having an open top.

DISCUSSION OF RELATED ART

Various types of handbags, purses, clutches, fanny packs, backpacks, etc. (collectively, "bags") are known in the art. Many are constructed of a closable design, e.g., to prevent the valuables and/or personal items carried therein from being readily visible and/or easily accessible to others, thereby reducing the opportunity for theft. Some such closable designs include a zipper closure that runs along a top of the bag. Many of such bags are relatively deep and/or lack internal organizers and/or have a large compartment lacking an internal organizer. As a result, carried items tend to accumulate in a jumble at the bottom of the bag, distant from the upper end of the bag and opening formed by the closure. The items are thereby obscured from sight by the bag's body and/or due to the poor visibility of the bottom of the bag relatively to the far distant opening of the upper closure. Accordingly, searching or rooting in the bag, blindly or with limited visibility, to find a desired item is a common activity.

Tote bags are also well-known in the art. Tote bags tend to have open tops without a closure, and thus lack the privacy and/or security of closable bags. Many tote bags tend to be relatively deep, and thus they suffer similar problems with respect to a jumble of carried items, poor visibility, and the need for searching or rooting in the bag to find a desired item.

Cosmetic and other dedicated organizers tend to be compartmented items that are relatively shallow in depth, and can be used to store items longer in length than the depth by supporting them in an upright position, in which a portion of the stored items extend above the top of the organizer. This makes the stored items relatively easy to identify and retrieve, without a need for extensive searching or rooting, because the stored items are plainly visible, at least above the top of the organizer. However such organizers are not configured to be carryable in a manner similar to that of a bag, and in any event, they tend to lack a suitable closure that would make the organizer feasible for use in a manner similar to that of a conventional handbag/purse/clutch.

What is needed is a bag that is carryable and has a top closable in a conventional manner for use like a conventional bag, but also may be opened in a predetermined fashion, e.g. to provide for the enhanced visibility of an open-top organizer.

SUMMARY

The present invention provides a bag having a structured closure providing for at least two bag states, one in which the bag resembles a conventional handbag/purse/clutch/fanny pack/backpack, etc. ("bag") having a closed end/top, and another in which the bag has an open end/top. The structured closure is configured to cause the bag to be closable/openable in a predefined fashion determined by the structure of the closure.

The bag includes a bag body made of relatively flexible fabric and defining an internal cavity, and has a structured closure including relatively rigid strengthening ribs. The ribs are arranged on the flexible fabric in a selected spatial relationship to selectively stiffen and support the bag body in selected areas to define an overall shape of the bag, and to define at least one unsupported operative region of the flexible material that will be highly flexible due to the lack of overlying strengthening ribs. The ribs may be defined to extend continuously from end to end of a panel or side of the bag, and to be elongated across all or substantially all of the panel or side. The panel may be defined to have a distinct top and/or side edges, and to be joined on one (e.g., bottom) edge to a remainder of the bag body, so that the panel defines a flap for closure purposes. Accordingly, a structured closure is defined that causes the bag to be opened and assume open states in a defined fashion defined by the structured closure, e.g., folding open at one or more of the operative regions.

In certain embodiments, the ribs are spaced in asymmetrical fashion, e.g., to provide greater spacing between selected ribs to provide a preferred operative region having an increased tendency of the bag body to bend/fold at the preferred operative region. Accordingly, the structured closure may be defined to cause the bag to be opened and to promote assumption of a particular preferred open state in a defined fashion defined by the structured closure, e.g., folding open at the preferred operative region.

In certain embodiments, the bag body defines an organizer structure in the internal cavity, and the bag is thus a hybrid bag including a conventional organizer having an open top. In such embodiments, the structured closure may be configured to provide easy access to the open top of internal organizer structure by defining a preferred operative region in vertical alignment with (e.g., in close proximity to) a top end of the open top of the organizer, such that the structured closure is configured to promote assumption of a particular preferred open state that provides easy access to the open top of the organizer, due to the structure of the structured closure.

BRIEF DESCRIPTION OF THE FIGURES

An understanding of the following description will be facilitated by reference to the attached drawings, in which.

DETAILED DESCRIPTION

The present invention provides a bag having a structured closure providing for at least two bag states, one in which the bag resembles a conventional handbag/purse/clutch having a closed end/top, and another in which the bag has an open end/top. The structured closure is configured to provide physical support/structure to the bag and to cause the bag to be closable/openable in a predefined structured fashion determined by the structure of the closure.

The bag includes a bag body made of flexible fabric and defining an internal cavity, and has a structured closure including rigid strengthening ribs. The ribs are arranged on the flexible fabric in a selected spatial relationship to selectively stiffen and support the bag body in selected areas to define an overall shape of the bag, and to define at least one unsupported operative region of the flexible material that will be highly flexible due to the lack of overlying strengthening ribs. The ribs may be defined to extend continuously from end to end of a panel or side of the bag, and to be elongated across all or substantially all of the panel or side. Accordingly, a structured closure is defined that causes the bag to have defined structure and to be opened and assume open states in a defined fashion defined by the structured closure, e.g., folding open at one or more of the operative regions.

In certain embodiments, the ribs are spaced in asymmetrical fashion, e.g., to provide greater spacing between selected ribs to provide a preferred operative region having an increased tendency of the bag body to bend/fold at the preferred operative region. Accordingly, the structured closure may be defined to cause the bag to be opened and to promote assumption of a particular preferred open state in a defined fashion defined by the structured closure, e.g., folding open at the preferred operative region.

In certain embodiments, the bag body defines an organizer structure in the internal cavity, and the bag is thus a hybrid bag including a conventional organizer having an open top. In such embodiments, the structured closure may be configured to provide easy access to the open top of internal organizer structure by defining a preferred operative region in vertical alignment with (e.g., in close proximity to) a top end of the open top of the organizer, such that the structured closure is configured to promote assumption of a particular preferred open state that provides easy access to the open top of the organizer, due to the structure of the structured closure.

Figure 1:
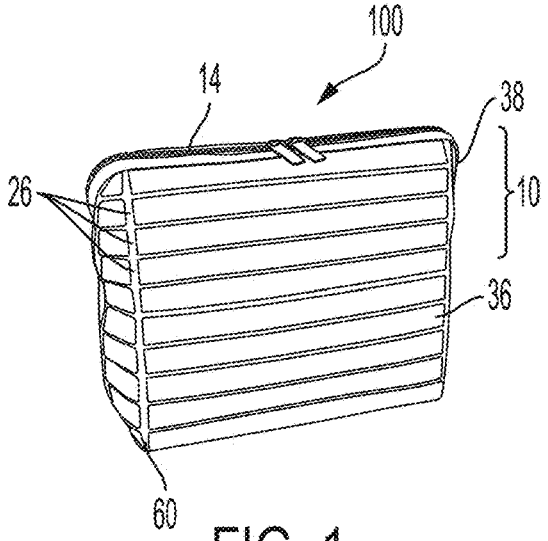
FIG. 1 is a front perspective view of an exemplary bag in accordance with an exemplary embodiment of the present invention, showing the bag with its closure and fastener in a closed state.
Figure 2:
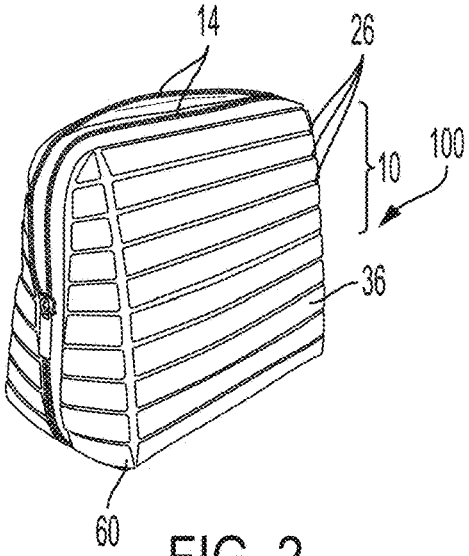
FIG. 2 is a front perspective view of an exemplary bag in accordance with an exemplary embodiment of the present invention, showing the bag with its closure in the closed state and the fastener in a partially-open state.

An exemplary embodiment of the present invention is discussed below for illustrative and non-limiting purposes. FIG. 1 is a front perspective view of an exemplary bag 100 in accordance with an exemplary embodiment of the present invention, showing the bag 100 with its structure closure 10 and fastener 14 in a closed state. FIG. 2 is a front perspective view of an exemplary bag 100 of FIG. 1, showing the bag with its structured closure 10 in the closed state and the fastener 14 in a partially-open state.

Figure 3:
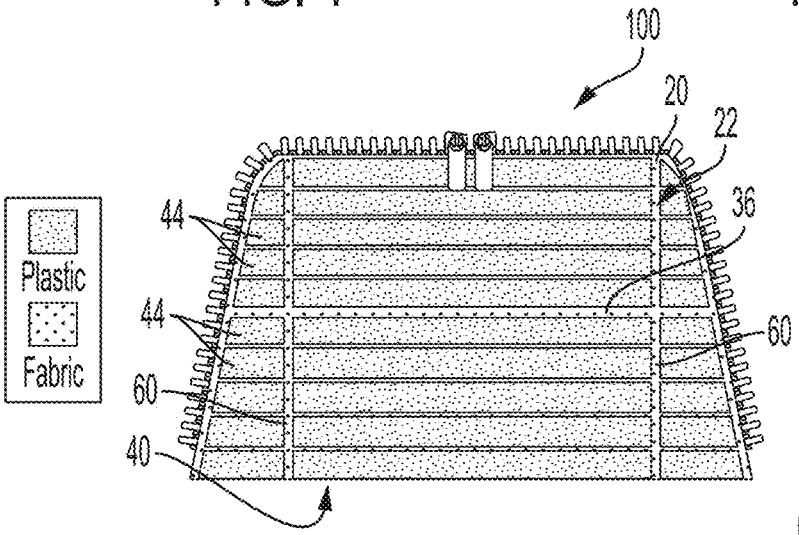
FIG. 3 is a front view of a front panel the bag of FIG. 1.
Figure 4:
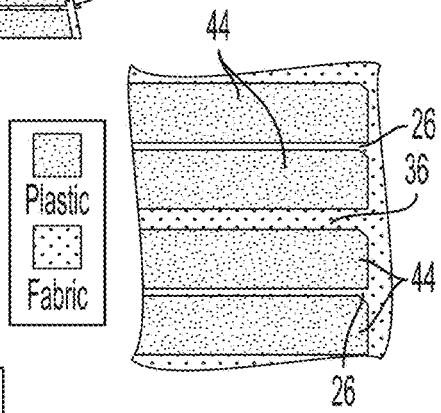
FIG. 4 is an enlarged detail view of a portion of the front view of the bag shown in FIG. 3.
Figure 5:
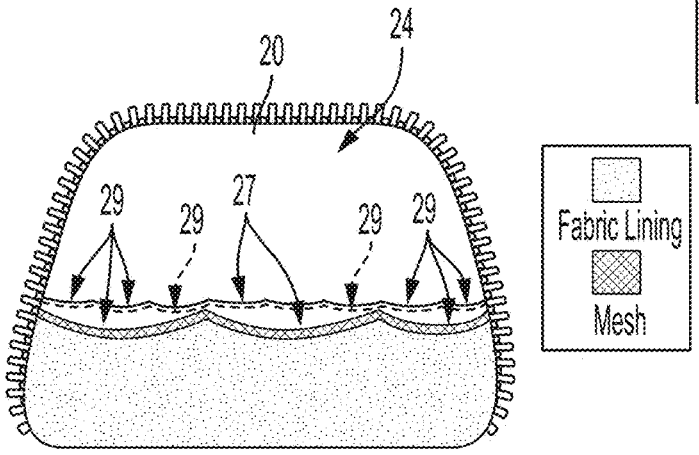
FIG. 5 is a rear view of the front panel of FIG. 3.

The bag 100 includes similar front and rear panels 20, 30, a base panel 40, and an end panel 50. FIGS. 3 and 5 are front and rear views, respectively of a front panel 20 of the bag 100. In this exemplary embodiment, the rear panel 30 is substantially the same as the front panel 20. Each of the front and rear panels 20, 30, has an exterior surface 22, 32 and an interior surface 24, 34. Each of the panels is constructed of a highly flexible/pliable material of a type often used in handbags, such as a woven nylon fabric. The base panel 40 and end panel 50 may be formed of similar materials. Collectively, these panels form a bag body 38 enclosing an internal cavity 37 for receiving personal items to be carried by the bag.

Accordingly, the bag body 38 alone would be relatively shapeless and unstructured based on highly flexible/pliable material alone, and thus would not have a well-defined shape, such as a typical structured handbag, purse, clutch, backpack or other shape having well-defined and generally self-support structure.

However, the bag is configured to have a defined structure. More particularly, the exterior surfaces 22, 32 of each of the front and rear panels 20, 30 is provided with strengthening ribs 44 of a relatively rigid material, namely, a material that is more rigid that the flexible/pliable material of the bag body. By way of example, the rigid strengthening ribs may be die-cut from a sheet, and by way of further example, the sheet and ribs may be made of a PVC or other plastic material, although other relatively rigid materials may be used.

The ribs 44 are fixed to the material, e.g., by adhesive or by welding (ultrasonically or otherwise). These relatively rigid ribs serve to provide structure to the bag, most particularly, in the areas in which the relatively stiff rib overlies the relatively flexible material of the panels. Accordingly, the ribs tend to prevent bending/folding in the areas of the ribs, and because of their spacing, permit bending/folding in areas of the bag body that are not overlain by the ribs.

The individual ribs 44 may be generally rectangular in shape, and/or may be otherwise elongated in the horizontal direction relative to an upright bag, as shown in FIGS. 1 and 2. In certain embodiments, the ribs extend continuously along a panel of the bag body and/or in the horizontal direction from end-to-end/corner-to-corner of the intended bag body shape, so as to support the flexible bag body to the bag to assume the desired well-defined shape, e.g., as shown in FIGS. 1 and 2.

Further, the individual ribs 44 may be arranged in a spaced relationship in the vertical direction, as shown in FIGS. 1 and 2, and may be arranged with narrow spacing. Accordingly, operative regions of the bag body 38 are defined between the ribs 44. For example, operative regions 26 are defined on each of the front and rear panels 20, 30 between adjacent ribs 44 on each panel. The operative regions 26 permit the bag body to bend/fold, and the ribs prevent the bag body from bending/folding at the area overlain by the ribs. Preferably, the operative regions 26 extend between ribs 44 linearly, and preferably horizontally, along parallel lines. This causes the bag to be foldable in a defined fashion defined by the placement of the ribs, in a fashion somewhat resembling operation of an operative portion of a roll-top desk.

Figure 6:
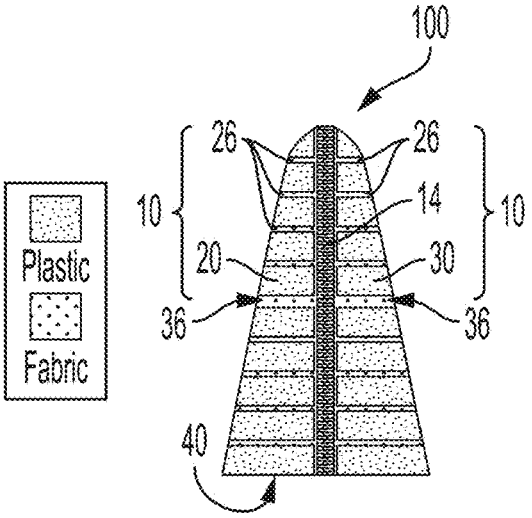
FIG. 6 is a side view of the bag of FIG. 1, showing the bag with its closure and fastener in closed states.
Figure 7:
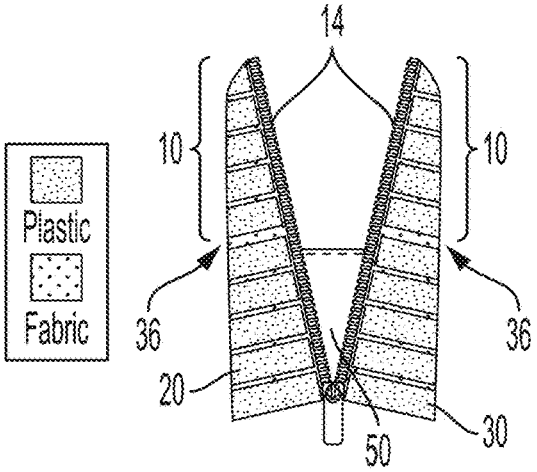
FIG. 7 is a side view of the bag of FIG. 1, showing the bag with its closure in the closed state and its fastener in an open state.

Accordingly, the operative regions 26 define portions of the panels 20, 30 acting as structured closures 10, in that the closure 10 portions of the panels 20, 30 are operative to move between a closed position in which the fastener 14 can be used to close the bag (see FIG. 6), and an open position, in which the inner portion of the bag is revealed (see FIG. 7). The end panels 50 may connect the panels 20, 30 to provide structure to the bag body and/or to contain items in the internal cavity 37.

Accordingly, the ribs are configured to support the bag body in selected areas to define an overall shape of the bag, and are arranged on the flexible fabric bag body in a selected spatial relationship to selectively stiffen the bag in desired regions and to define at least one unsupported operative region of the flexible material that will be highly flexible due to the lack of overlying strengthening ribs. Accordingly, a structured closure is defined that causes the bag to have defined structure and to be opened and assume open states in a defined fashion defined by the structured closure, e.g., folding open at one or more of the operative regions.

In certain embodiments, the ribs 44 are spaced in asymmetrical fashion, e.g., to provide greater spacing between selected ribs 44 to provide a preferred operative region 36 having an increased tendency of the bag body to bend/fold at the preferred operative region 36, as shown in FIGS. 1-4. Thus, the preferred operative region is defined by spacing between adjacent ribs that is greater than a spacing between other ribs, to provide an enhanced tendency of the panel to fold at the operative region 26, 36. Accordingly, the structured closure may be defined to cause the bag to be opened and to promote assumption of a particular preferred open state in a defined fashion defined by the structured closure, e.g., folding open at the preferred operative region 36.

In certain embodiments, the bag body defines an organizer structure in the internal cavity, and the bag is thus a hybrid bag including a conventional organizer having an open top. In such embodiments, the structured closure may be configured to provide easy access to the open top of internal organizer structure by defining a preferred operative region 36 in vertical alignment with (e.g., in close proximity to) a top end of the open top of the organizer, such that the structured closure is configured to promote assumption of a particular preferred open state that provides easy access to the open top of the organizer, due to the structure of the structured closure.

In the example of FIGS. 1-12, the inner surface 24, 34 of the panels 20, 30 defines mesh and/or non-mesh pockets 27 extending vertically with open tops 29, to define an organizer structure, as shown in FIG. 5.

Preferably, the ribs 44 are arranged, and the operative region 36 is defined, so that the operative region is located at, or close to, and upper edge of the pockets and compartments defined by divider panels 60*a*, 60*b*. The preferred operative regions 36 in this example are defined to be substantially linear at a location at or corresponding to (in close proximity, above or below) an upper edge of the bag's organizer structure. The preferred operative regions cause an upper portion of the bag body (closure 10) to tend to fold or to be foldable at the specified operative region to cause an upper portion of the bag/panel to fold downwardly, e.g., at the upper edge of the bag's organizer structure, to place the bag in an open state in which it resembles a conventional organizer having an open top, and in which the contents are highly visible. Further, this operative region further permits the relevant portion of the panel/closure 10 to fold toward a closed position, in which the bag's panel(s) is/are generally upright (in a closed position), so that a fastener can be secured to place the bag in a closed state in which the hybrid bag resembles a conventional handbag/purse/clutch having a closed top, to obscure and secure items carried within the bag. Thus, this hybrid bag is carryable and closable in a manner similar to that of a conventional bag, but also provides for the enhanced visibility of an open-top organizer.

Figure 13A:
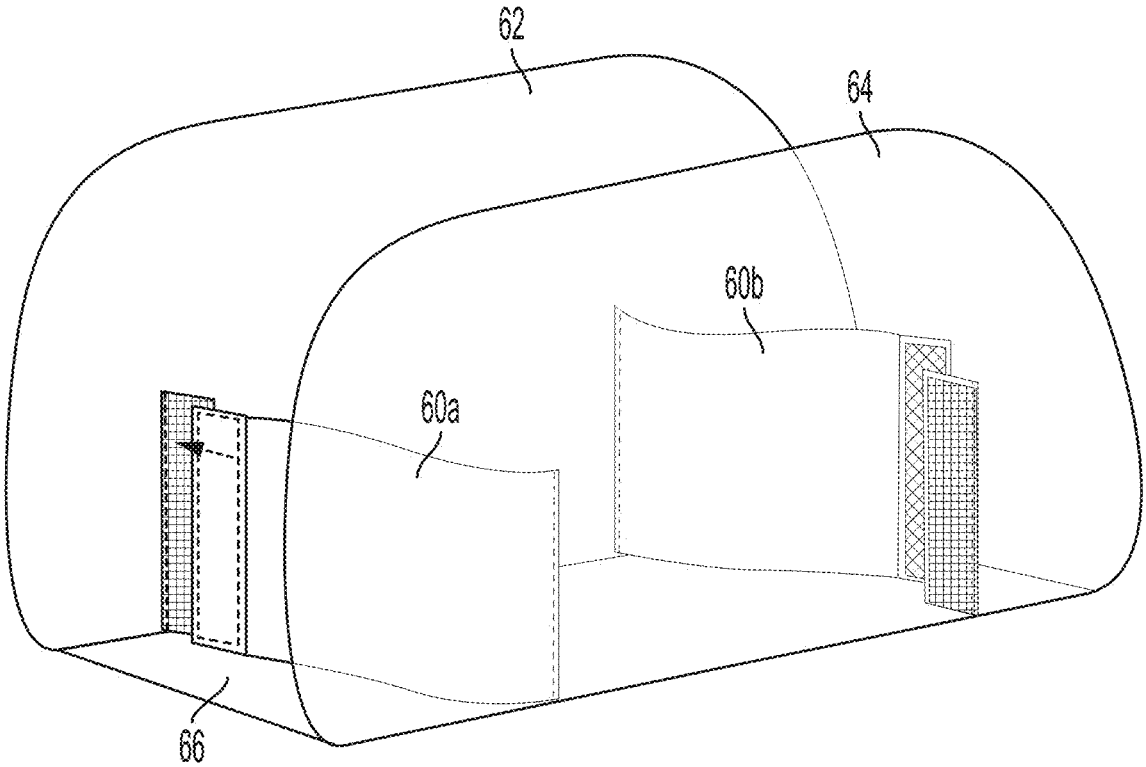
FIGS. 13A and 13B are perspective and top views of the front and rear panels of the bag of FIG. 1, showing partition panels in an active state, with portions of the bag removed for illustrative clarity.
Figure 13B:
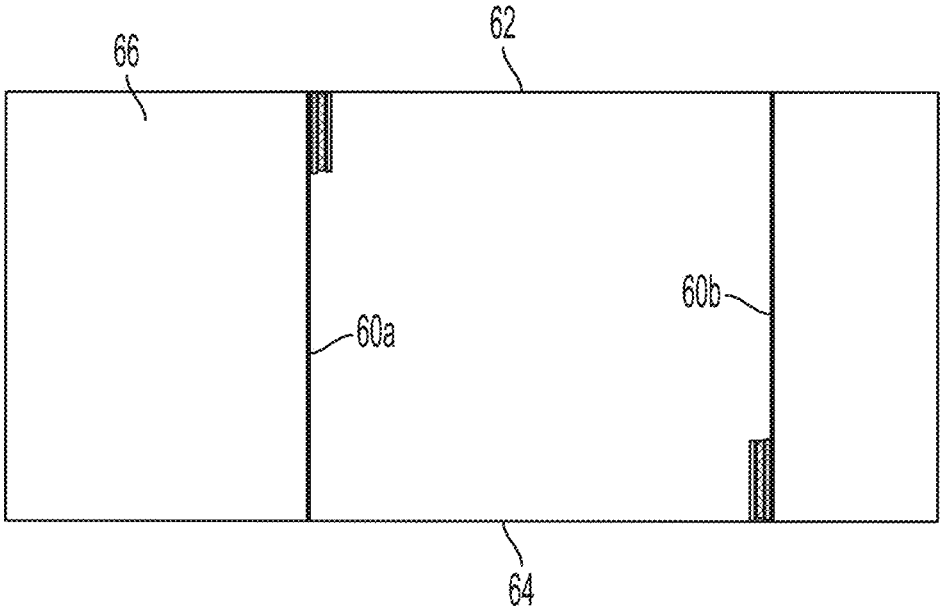
Figure 14A:
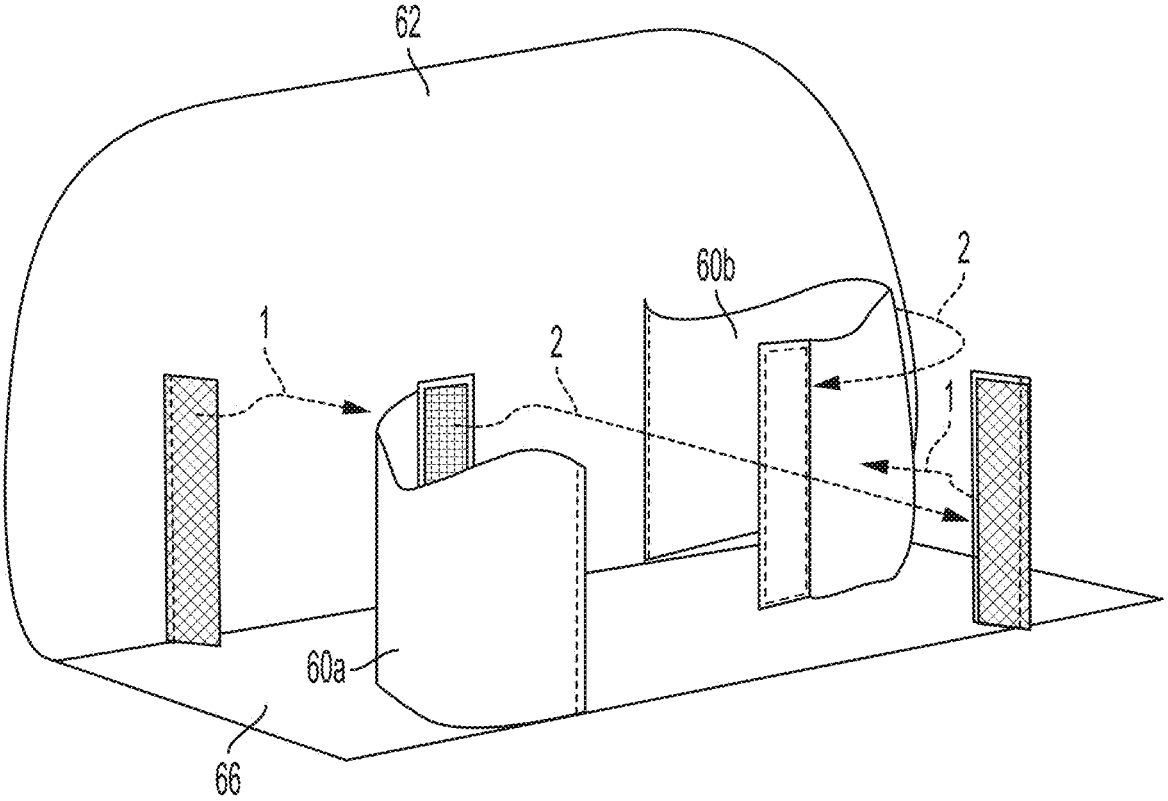
FIGS. 14A and 14B are perspective and top views of the front and rear panels of the bag of FIG. 1, showing partition panels in a detached state, with portions of the bag removed for illustrative clarity.
Figure 14B:
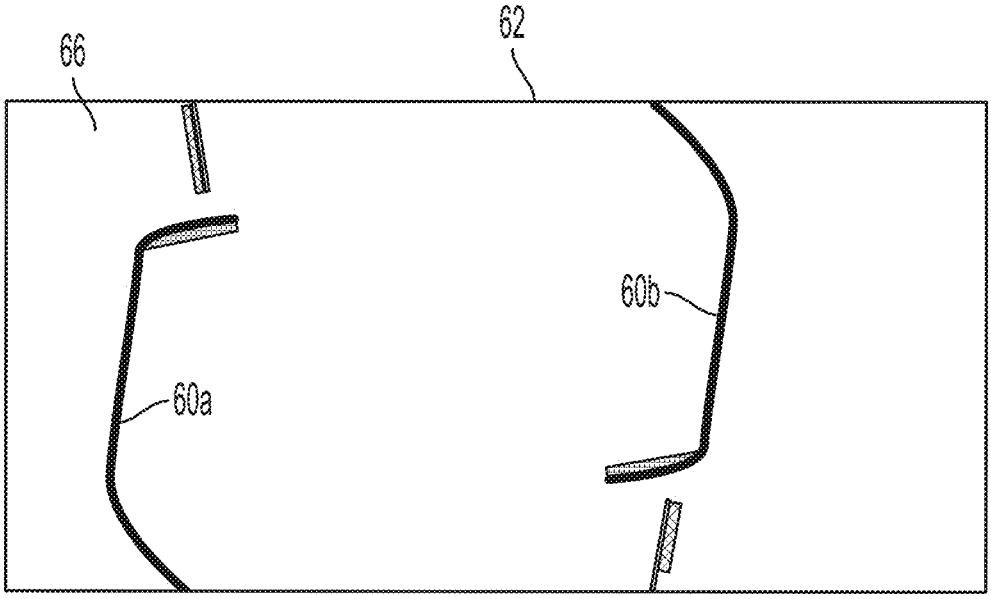
Figure 15A:
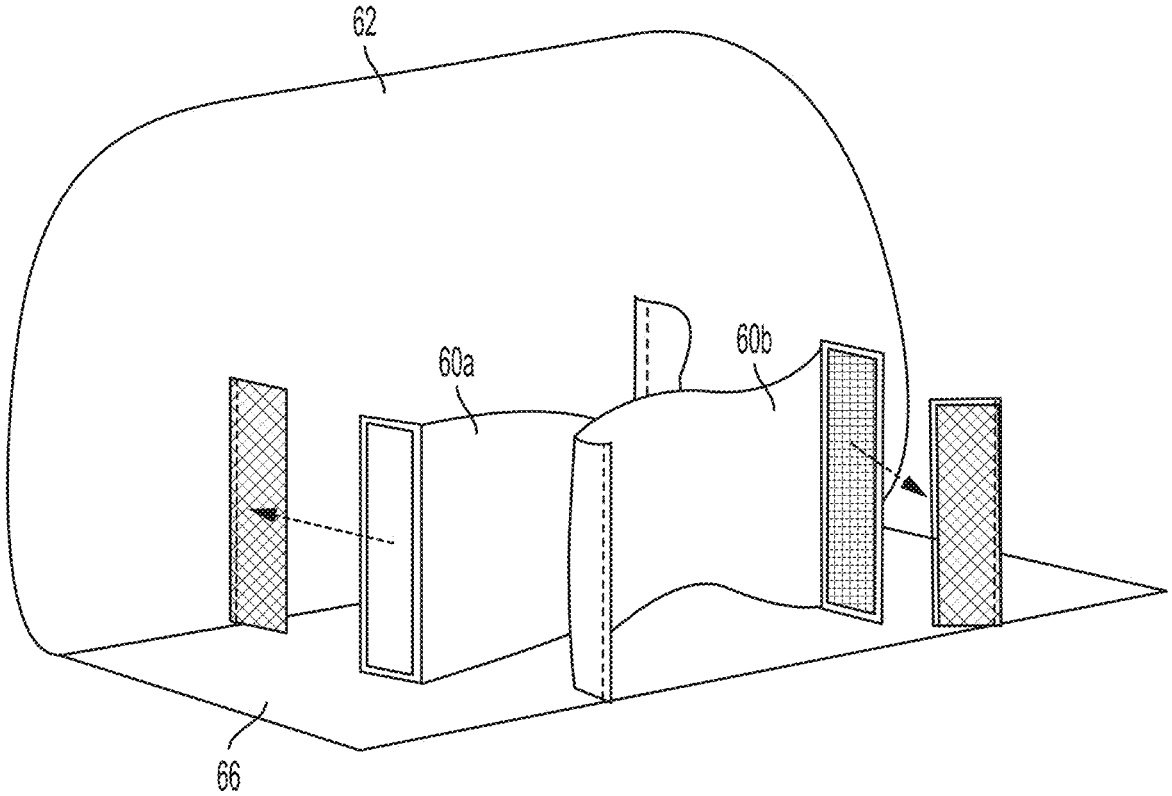
FIGS. 15A and 15B are perspective and top views of the front and rear panels of the bag of FIG. 1, showing partition panels moved toward an inactive state, with portions of the bag removed for illustrative clarity.
Figure 15B:
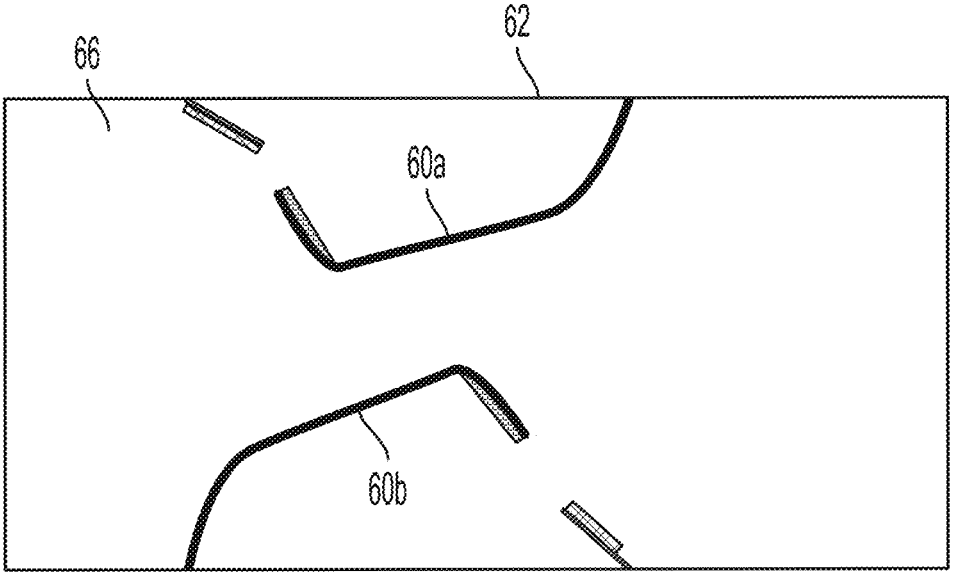
Figure 16A:
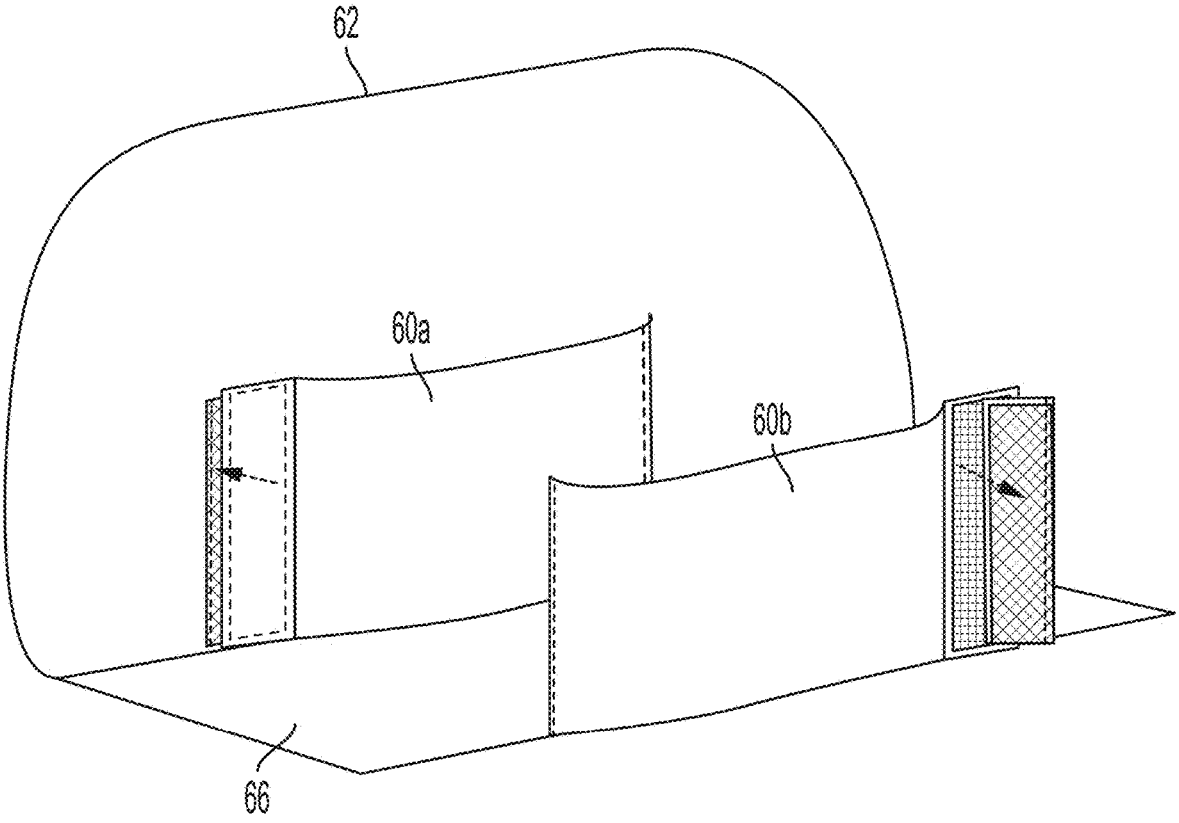
FIGS. 16A and 16B are perspective and top views of the front and rear panels of the bag of FIG. 1, showing partition panels in the inactive state, with portions of the bag removed for illustrative clarity.
Figure 16B:
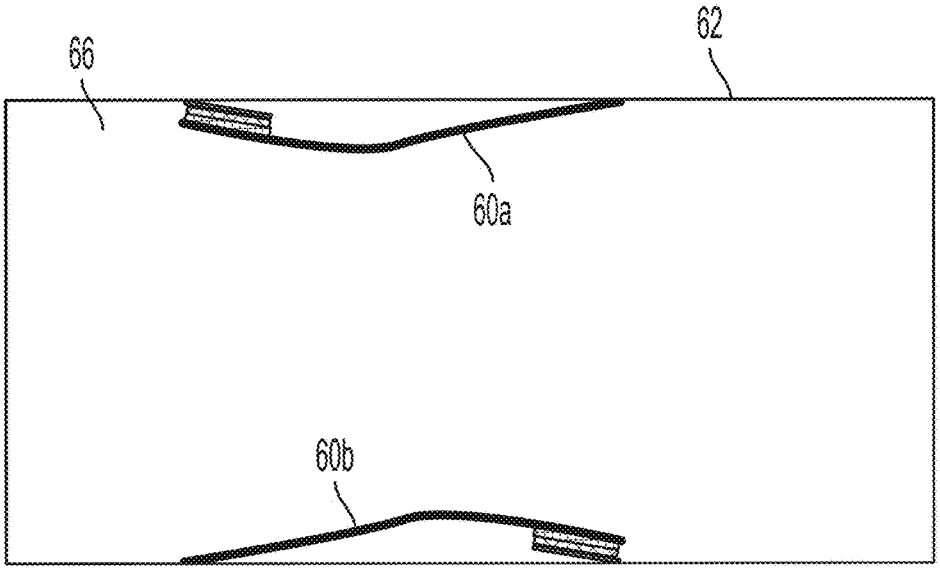

Optionally, the inner surface 24, 34 of the panels 20, 30 may include divider panels 60*a*, 60*b*, which may be configurable to define compartments 62, 64, 66 defining an organizer structure, as shown in FIGS. 7, 8, 11 and 13A-16B. FIGS. 13A and 13B are perspective and top views of the front and rear panels of the bag of FIG. 1, showing partition panels in an active state, with portions of the bag removed for illustrative clarity. FIGS. 14A and 14B are perspective and top views of the front and rear panels of the bag of FIG. 1, showing partition panels in a detached state, with portions of the bag removed for illustrative clarity. FIGS. 15A and 15B are perspective and top views of the front and rear panels of the bag of FIG. 1, showing partition panels moved toward an inactive state, with portions of the bag removed for illustrative clarity. FIGS. 16A and 16B are perspective and top views of the front and rear panels of the bag of FIG. 1, showing partition panels in the inactive state, with portions of the bag removed for illustrative clarity.

Accordingly, as shown in FIGS. 1-12, the panels 20, 30 of the exemplary bag shown tend to be foldable downwardly within the preferred operative regions 36 such that the upper edges 39 of the folded panels closely corresponds to a top edge 27 of the open tops of the pockets 26, 28 and compartments 62, 64, 66 defined by the divider panels 60*a*, 60*b*, when the fastener 14 is in an open state (as in FIG. 7) and when the closure 10 is also in an open state (as shown in various states in FIGS. 8-12).

Figure 8:
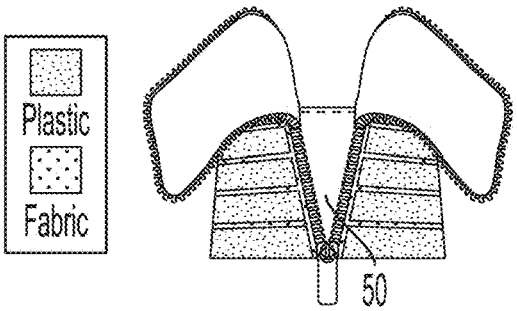
FIG. 8 is a side view of the bag of FIG. 1, showing the bag with its closure in a partially-open state, and its fastener in the open state.
Figure 9:
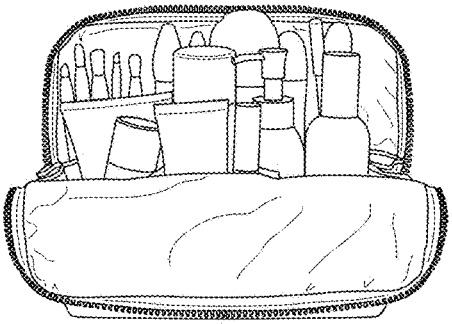
FIG. 9 is a front view of the bag of FIG. 1, showing the bag with a front panel of its closure in a fully-open state.
Figure 10:
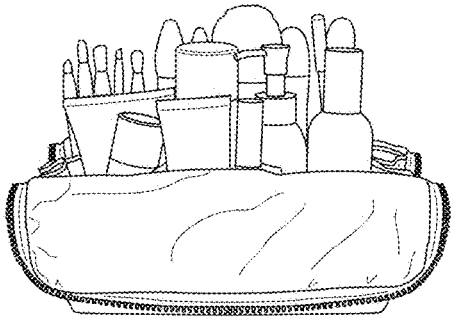
FIG. 10 is a front view of the bag of FIG. 1, showing the bag with its front and rear panels of its closure in a fully-open state.
Figure 12:
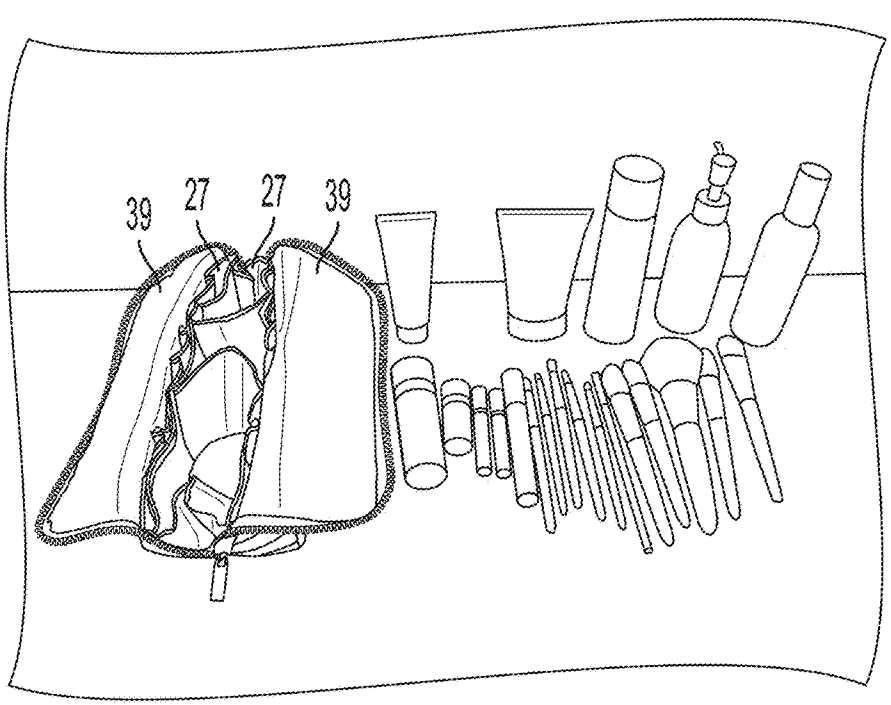
FIG. 12 is a top view of the bag of FIG. 1, showing the bag with its front and rear panels of its closure in a fully-open state.
Figure 11:
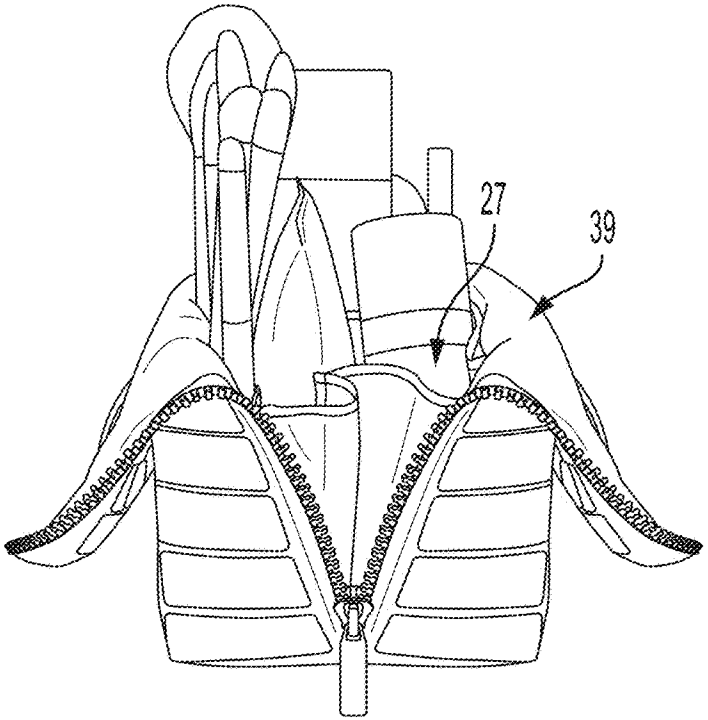
FIG. 11 is a side view of the bag of FIG. 1, showing the bag with its front and rear panels of its closure in a fully-open state.

Optionally, the fastener 14 may be provided as a zipper closure. Optionally, the zipper closure may extend from the top of the bag body beyond (below) the operative region(s) defined by the strengthening ribs, as shown in FIGS. 7, 8 and 11. This allows the panels 20, 30 to open more fully. In such an embodiment, the end panel 50 may be joined at its side edges to the front/rear panels 20, 30 to serve to limit the separation of the front/rear panels 20, 30 when the fastener is in a fully open position as shown in FIGS. 7, 8 and 11.

Optionally, the ribs 44 may be segmented in their direction of elongation, as shown in FIG. 3. This may form one or more secondary unsupported regions 60 that are not overlain by a less-flexible strengthening rib. As shown in FIGS. 1-3. The unsupported region(s) 60 that be aligned, e.g., vertically or otherwise transversely to a horizontally extending operative region 26), to promote bending and/or folding of the panels in the generally vertical unsupported regions, e.g., to effectively form ends of the bag, as best shown in FIGS. 1 and 2.

It should be noted that the bag described above is for illustrative purposes with reference to a bag including first and second panels that are front and rear panels. It should be appreciated, however, that the bag may have any desired number of panels, and may have any desired overall shape, i.e., not only the generally rectangular bag shown, but also circular, triangular, square, pentagonal and any other shape, as may be desired. In any case, the relevant panel or panels of any bag of any shape may include ribs having a first (narrower) spacing and a second (broader) spacing, such that an operative region is defined by the second spacing, such that the panel(s) of the bag have a greater relative tendency to fold within the operative region than in other regions, to cause the bag to define a structure closure and operate in an intended fashion dictated by its structure. Preferably, the operative region extends linearly and horizontally. Optionally, any such bag may have internal compartments and/or pockets, and optionally, the operative region may be vertically aligned, at or near (above or below) top portions, openings or edges of such internal compartments and/or pockets.

Figure 17A:
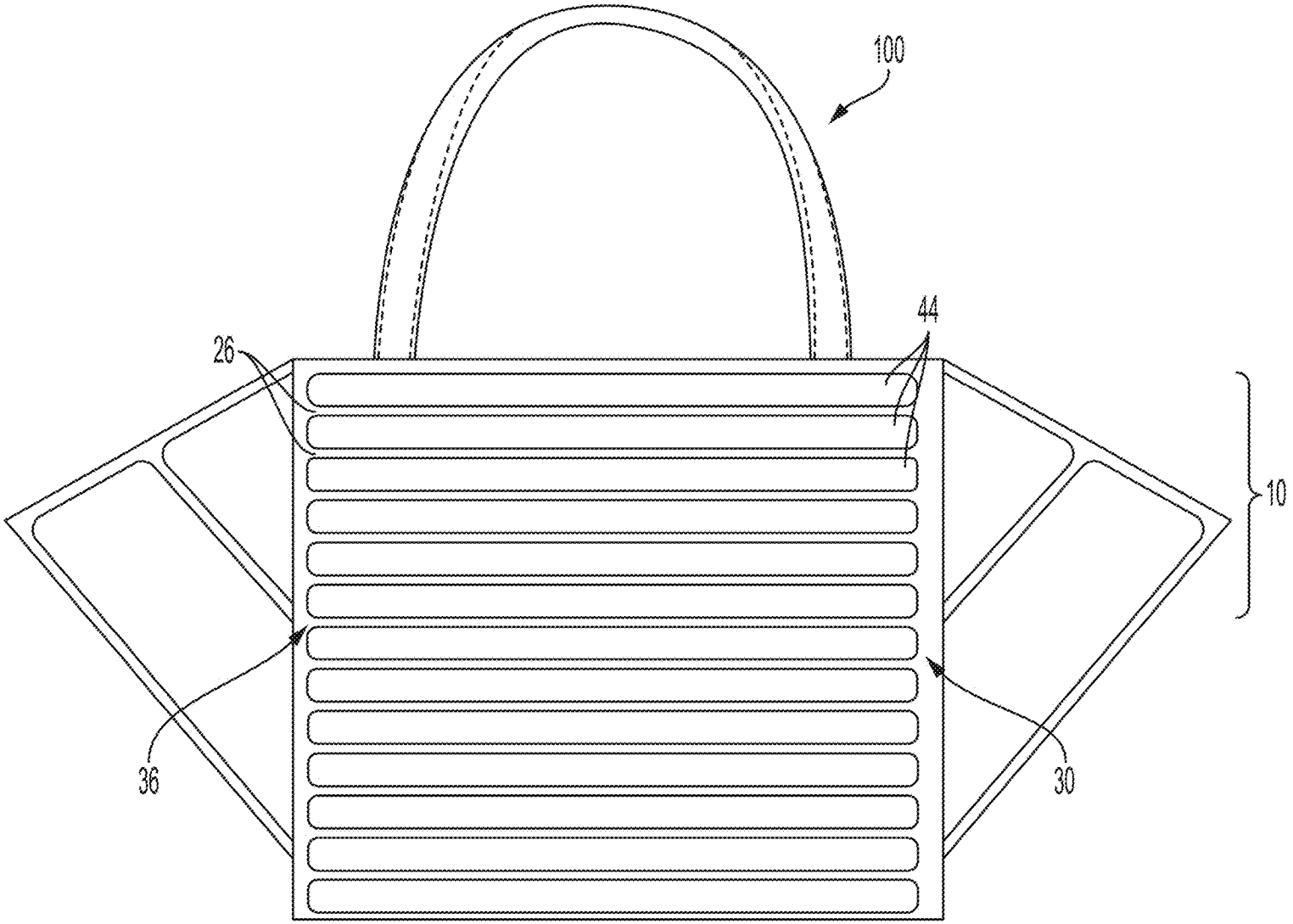
FIGS. 17A and 17B are front and perspective views of an alternative embodiment of a bag having an exemplary structured closure in accordance with the present invention.
Figure 17B:
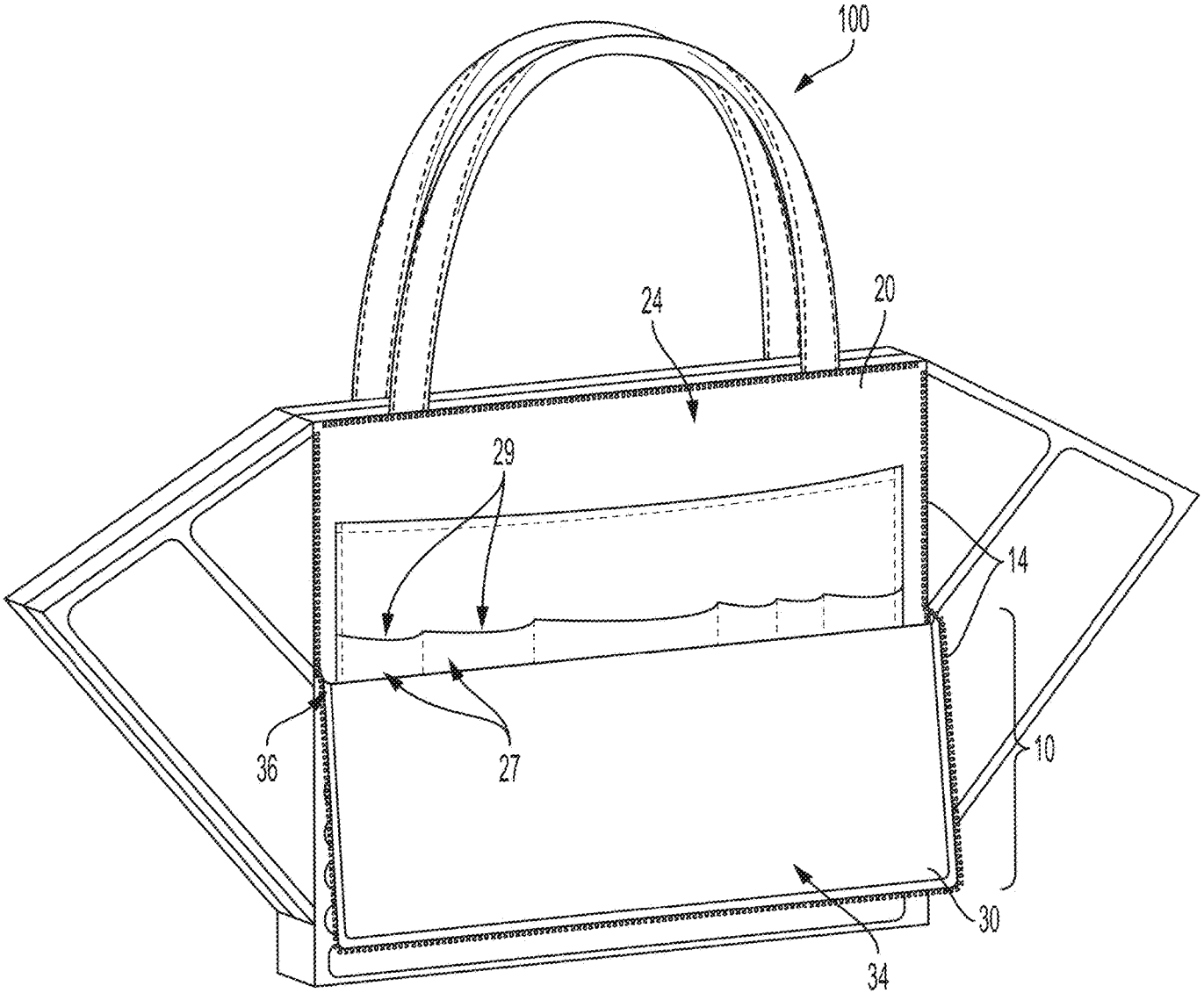

FIGS. 17A and 17B are front and perspective views of an alternative embodiment of a bag having an exemplary structured closure in accordance with the present invention. In this embodiment, the bag has an overall structure similar to that shown in FIGS. 1-16, and includes a bag body made of flexible fabric and defining an internal cavity, and has a structured closure including rigid strengthening ribs. The ribs are arranged on the flexible fabric in a selected spatial relationship to selectively stiffen and support the bag body in selected areas to define an overall shape of the bag, and to define at least one unsupported operative region of the flexible material that will be highly flexible due to the lack of overlying strengthening ribs. Further, the bag includes an internal organizer structure, and selected ribs are spaced in asymmetrical fashion, e.g., to provide greater spacing between selected ribs to provide a preferred operative region having an increased tendency of the bag body to bend/fold at the preferred operative region, and the preferred operative region is defined in vertical alignment with (e.g., in close proximity to) a top end of the open top of the organizer to provide easy access to the open top of internal organizer structure.

In this exemplary bag, structured as a handbag, however, only the front panel 30 is provided with the structured closure, and the rear panel 20 is designed without a structured closure, so as to remain upright during operation, as will be appreciated from FIGS. 17A and 17B.

Figure 18A:
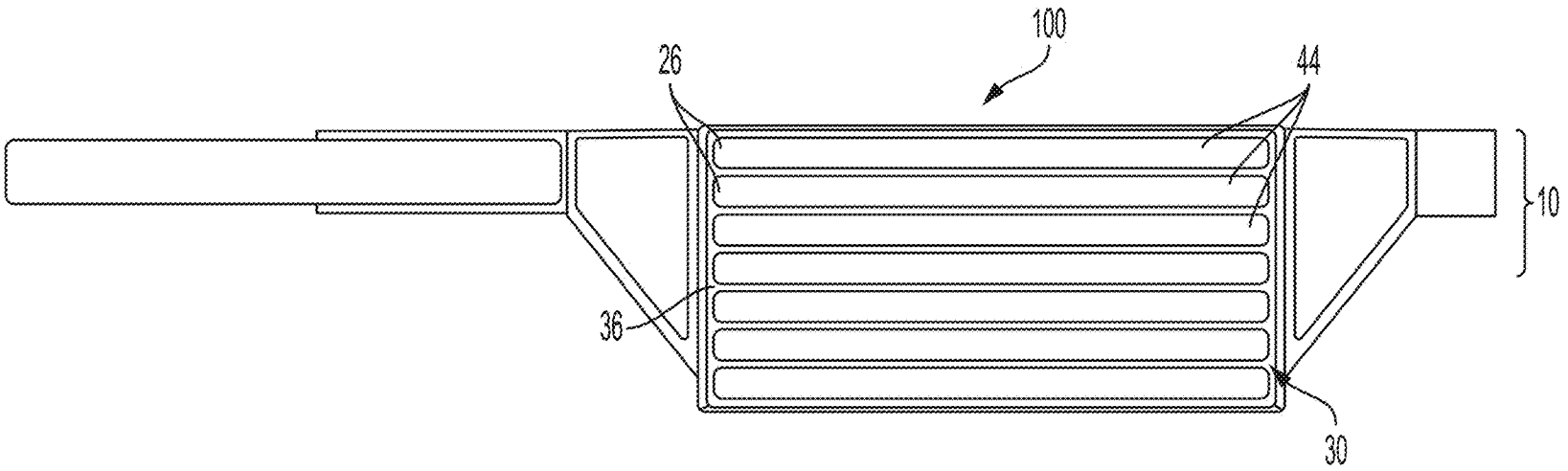
FIGS. 18A and 18B are front views of another alternative embodiment of a bag having an exemplary structured closure in accordance with the present invention.
Figure 18B:
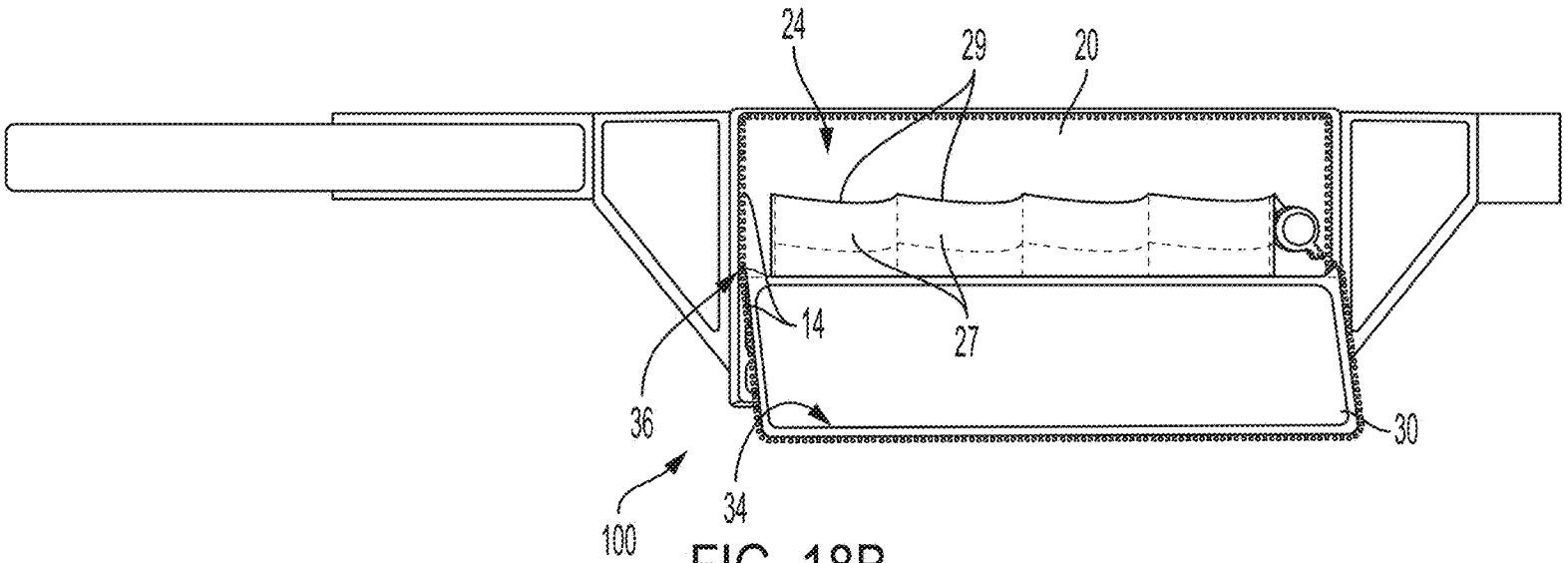

FIGS. 18A and 18B are front views of another alternative embodiment of a bag in accordance with the present invention. Like the bag shown in FIGS. 17A and 17B, only the front panel 30 is provided with the structured closure, and the rear panel 20 is designed without a structured closure, so as to remain upright during operation. In this exemplar embodiment, the bag is structured as a fanny pack-type bag.

Figure 19A:
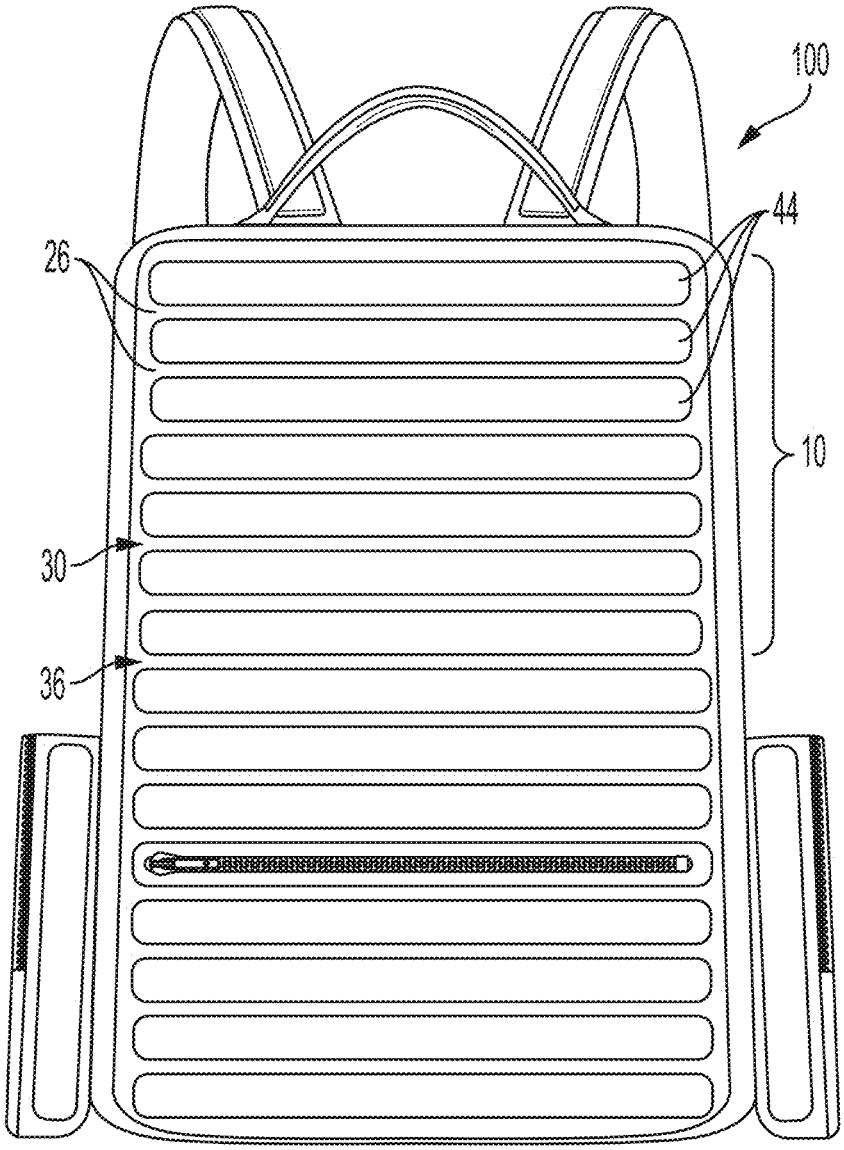
FIGS. 19A and 19B are front and perspective views of another alternative embodiment of a bag having an exemplary structured closure in accordance with the present invention.
Figure 19B:
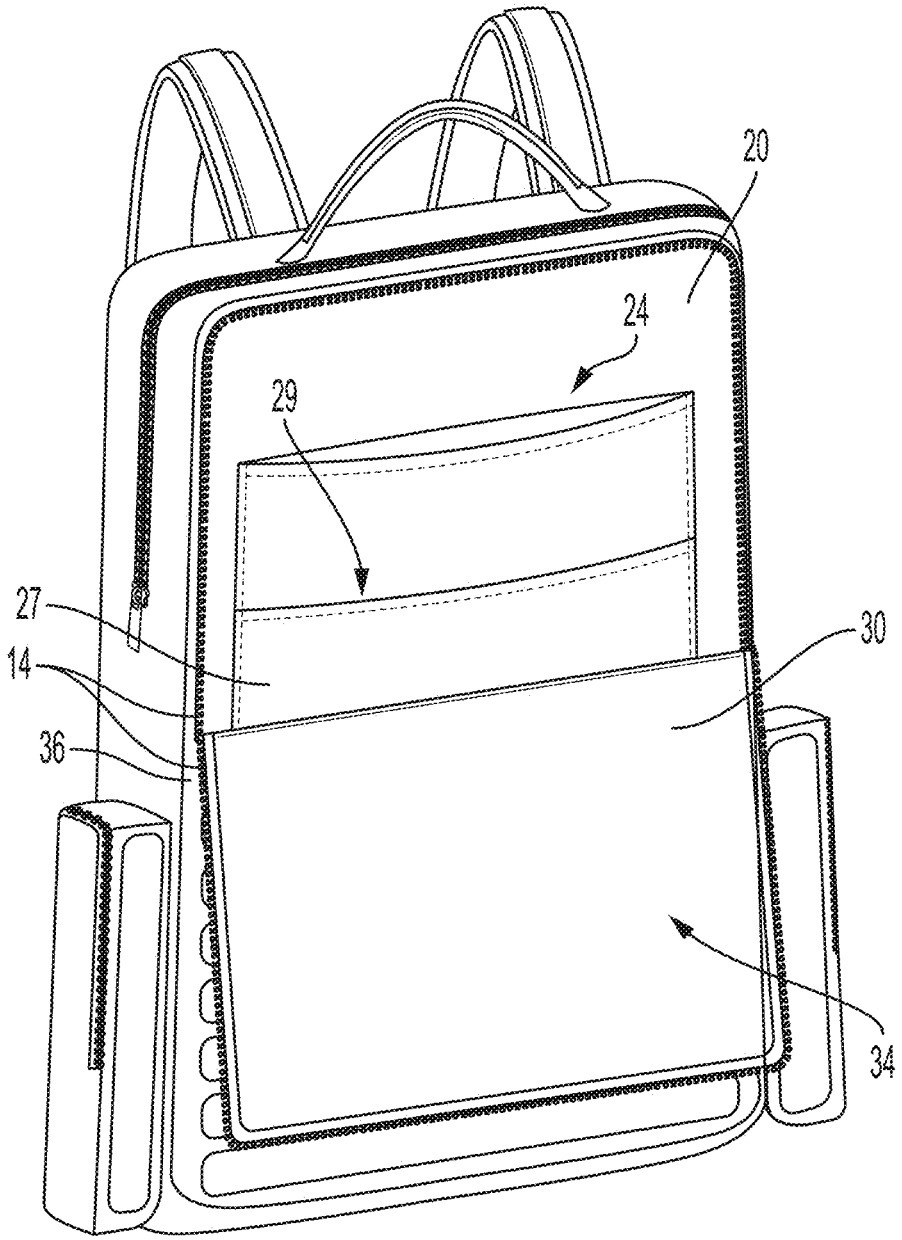

FIGS. 19A and 19B are front and perspective views of yet another alternative embodiment of a bag in accordance with the present invention. Like the bags shown in FIGS. 17A-18B, only the front panel 30 is provided with the structured closure, and the rear panel 20 is designed without a structured closure, so as to remain upright during operation. In this exemplary embodiment, the bag is structured as a backpack-type bag.

Optionally, the ribs can be die-cut or be modified to have an internal opening, e.g. for housing a zipper to form a pocket (see, e.g., FIG. 19A), and/or to be molded or contoured with an emboss or deboss, e.g., to aesthetic or other purposes.

While there have been described herein the principles of the invention, it is to be understood by those skilled in the art that this description is made only by way of example and not as a limitation to the scope of the invention. Accordingly, it is intended by the appended claims, to cover all modifications of the invention which fall within the true spirit and scope of the invention.

What is claimed is:

1. A structured bag for carrying items, the bag comprising:

a bag body constructed of a flexible material, said bag body comprising at least one panel;

a plurality of elongated ribs constructed of a material less flexible than said flexible material, at least a first pair of said plurality of elongated ribs being joined to said at least one panel in a spaced relationship, said spaced relationship defining an operative region promoting folding, within said operative region, of said at least one panel between an open state and a closed state, to form a structured closure for said bag; and a fastener secured to said at least one panel and operable to selectively fix said closure, and thus said bag, in the closed state; said plurality of ribs further comprising:

a second pair of said plurality of elongated ribs joined to said at least one panel in a second spaced relationship having a spacing greater than that of said spaced relationship, said second spaced relationship defining a preferred operative region promoting folding of said at least one panel between the open state and the closed state, to form said closure for said bag.

2. A structured bag for carrying items, the bag comprising:

a bag body constructed of a flexible material, said bag body comprising at least one panel;

a plurality of elongated ribs constructed of a material less flexible than said flexible material, at least a first pair of said plurality of elongated ribs being joined to said at least one panel in a spaced relationship, said spaced relationship defining an operative region promoting folding, within said operative region, of said at least one panel between an open state and a closed state, to form a structured closure for said bag;

a fastener secured to said at least one panel and operable to selectively fix said closure, and thus said bag, in the closed state; and:

at least one pocket formed on said at least one panel, said at least one pocket having a respective open top; and wherein said plurality of elongated ribs further comprises a second pair of said plurality of elongated ribs joined to said at least one panel in a second spaced relationship having a spacing greater than that of said spaced relationship, said second spaced relationship defining a preferred operative region promoting folding of said at least one panel between the open state and the closed state, to form said closure for said bag;

wherein said second pair of said plurality of elongated ribs is disposed on said at least one panel to define said preferred operative region at a location corresponding to said open top of said at least one pocket.

3. A structured bag for carrying items, the bag comprising:

a bag body constructed of a flexible material, said bag body comprising at least one panel;

a plurality of elongated ribs constructed of a material less flexible than said flexible material, at least a first pair of said plurality of elongated ribs being joined to said at least one panel in a first spaced relationship, and a second pair of said plurality of elongated ribs being joined to said at least one panel in a second spaced relationship having a spacing greater than that of said first spaced relationship, said second spaced relationship defining a respective preferred operative region promoting folding of said at least one panel between an open state and a closed state, to form a closure for said bag; and a fastener secured to said at least one panel and operable to selectively fix said closure, and thus said bag, in the closed state.

4. The structured bag of claim 3, wherein said at least one panel defines a flap joined along one edge to a remainder of said bag body.

5. The structured bag of claim 3, wherein said plurality of elongated ribs provides physical structure to said bag to prevent unsupported sagging of said flexible material and to cause said bag to assume a predefined shape in the closed state.

6. The structured bag of claim 3, wherein each of said plurality of elongated ribs extends continuously between ends of said at least one panel.

7. The structured bag of claim 3, wherein each of said plurality of elongated ribs is elongated in the horizontal direction, and wherein each of said operative regions is defined therebetween to be elongated in the horizontal direction.

8. The structured bag of claim 3, wherein said bag body comprises at least one additional panel, said at least one additional panel comprising an additional plurality of elongated ribs constructed of said material less flexible than said flexible material, at least an additional pair of said additional plurality of elongated ribs being joined to said at least one additional panel in spaced relationship.

9. The structured bag of claim 3, further comprising at least one pocket formed on said at least one panel, said at least one pocket having a respective open top.

10. The structured bag of claim 3, further comprising:

at least one pocket formed on said at least one panel, said at least one pocket having a respective open top; and wherein each pair of said plurality of elongated ribs is disposed on said at least one panel to define said preferred operative region at a location corresponding to said open top of said at least one pocket.

11. The structured bag of claim 3, further comprising:

at least one divider panel fixed to a first portion of said bag body, said at least one divider panel terminating in a free end selectively attachable to another portion of said bag body to define at least one compartment.

12. A structured bag for carrying items, the bag comprising:

a bag body constructed of a flexible material, said bag body comprising at least one panel;

at least one pocket formed on said bag body, said at least one pocket having a respective open top;

a plurality of elongated ribs constructed of a material less flexible than said flexible material, at least a first pair of said plurality of elongated ribs being joined to said at least one panel in a first spaced relationship, and a second pair of said plurality of elongated ribs being joined to said at least one panel in a second spaced relationship having a spacing greater than that of said first spaced relationship, said second spaced relationship defining a respective preferred operative region promoting folding of said at least one panel between an open state and a closed state, to form a closure for said bag, said second pair of said plurality of elongated ribs being disposed on said at least one panel to define said preferred operative region at a location corresponding to said open top of said at least one pocket; and a fastener secured to said at least one panel and operable to selectively fix said closure, and thus said bag, in the closed state.

13. The structured bag of claim 12, wherein said at least one panel defines a flap joined along one edge to a remainder of said bag body.

14. The structured bag of claim 12, wherein said plurality of elongated ribs provides physical structure to said bag to prevent unsupported sagging of said flexible material and to cause said bag to assume a predefined shape in the closed state.

15. The structured bag of claim 12, wherein each of said plurality of elongated ribs extends continuously between ends of said at least one panel.

16. The structured bag of claim 12, wherein each of said plurality of elongated ribs is elongated in the horizontal direction, and wherein each of said operative regions is defined therebetween to be elongated in the horizontal direction.

17. The structured bag of claim 12, wherein said bag body comprises at least one additional panel, said at least one additional panel comprising an additional plurality of elongated ribs constructed of said material less flexible than said flexible material, an additional pair of said additional plurality of elongated ribs being joined to of said at least one additional panel in spaced relationship.

18. The structured bag of claim 12, further comprising:

at least one divider panel fixed to a first portion of said bag body, said at least one divider panel terminating in a free end selectively attachable to another portion of said bag body to define at least one compartment.

* * * * *